United States Patent [19]

Carty

[11] 4,348,947

[45] Sep. 14, 1982

[54] SELF-CLEANING CHIMNEY STACK

[75] Inventor: John J. Carty, Rocky Point, N.Y.

[73] Assignee: Luftek, Inc., Shoreham, N.Y.

[21] Appl. No.: 226,928

[22] Filed: Jan. 21, 1981

[51] Int. Cl.[3] ..... F23L 17/02

[52] U.S. Cl. ..... 98/58; 110/184

[58] Field of Search ..... 98/58-60; 110/184; 114/187

[56] References Cited

U.S. PATENT DOCUMENTS

| | | | |
|---|---|---|---|
| 3,669,042 | 6/1972 | Lawrence | 98/60 X |
| 3,727,566 | 4/1973 | Roy | 98/60 X |
| 3,762,302 | 10/1973 | Plot | 110/184 X |
| 4,064,793 | 12/1977 | Bennett | 110/184 X |
| 4,111,107 | 9/1978 | Engelke | 110/184 X |
| 4,216,709 | 8/1980 | Bottenbruch | 98/58 |

FOREIGN PATENT DOCUMENTS

| | | | |
|---|---|---|---|
| 1196313 | 7/1965 | Fed. Rep. of Germany | 110/184 |

*Primary Examiner*—William E. Tapolcai

[57] ABSTRACT

This invention relates to an improved design associated with the fabrication and construction of a double shell chimney stack capable of conveying hot gases generated in conjunction with industrial endeavors to a height within the atmosphere sufficient to meet current pollution standards. In accordance with the invention, an inner core member thermally insulated is contained within, as well as supported by, an upright outer structural column member, there being selectively positioned on the exterior wall of said inner core member, between said inner core member and said outer structural member, vibrator mechanisms capable of being selectively actuated so as to vibrate said inner core member when desired. In this manner, the double shell chimney is in effect self cleaning without requiring the shutting down of the stack to achieve same since by mechanically vibrating the inner core member of said double shell chimney during its normal operations, particulate matter is prevented from building up on said inner surface of said inner core member as well as being dislodged from the inner surface of said inner core member and is either allowed to fall to the bottom of said chimney stack whereupon it is removed in a manner well known in the prior art or said particulate matter passes out of the top of the chimney stack with the rising gasses passing through said chimney stack. Additionally, there is also incorporated in the overall design of said chimney stack means as part of the inner core member of said chimney stack for maintaining the flue gas temperature above the acid dewpoint temperature of the various acid vapors contained in said flue gases passing through said stack as well as additionally incorporating in the overall design of said chimney stack means for creating a pressure differential between the air space existing between the inner core member of said chimney stack and the outer structural column member and the center passageway of said chimney stack thereby reducing to a minimum maintenance requirements associated with said chimney stack as well as extending their operating life. By incorporation of the above in an overall design for a chimney stack, the advantages and achievements of the present invention are realized.

5 Claims, 8 Drawing Figures

SELF-CLEANING CHIMNEY STACK

BACKGROUND AND OBJECTS OF THE INVENTION

The present invention relates generally to a new and improved design associated with the fabrication and construction of a chimney stack capable of conveying hot gases generated in conjunction with industrial endeavors to a height within the atmosphere sufficient to meet current pollution standards whereby said chimney stack is basically self-cleaning.

Prior to the present invention, industrial chimney stacks were known, but of a design which did not lend themselves to the advantages and overall efficiencies achievable in conjunction with the present invention.

It is in the context of the above that one of the primary objectives of the present invention is to create a new and improved design associated with the fabrication and construction of a chimney stack capable of conveying hot gases generated in conjunction with industrial endeavors to a height within the atmosphere sufficient to meet current pollution standards that overcomes problems currently existing in the prior art.

It is another object of this invention to create a new and improved design associated with the fabrication and construction of a chimney stack whose design permits the cleaning thereof without the need to shut down the operation of said chimney stack to achieve same as well as whose design prevents the build up of particulate material while minimizing the deterioration of the structural portion of a chimney stack due to same coming into contact with corrosive acids whose vapors are being carried through said chimney stack for venting to the upper atmosphere.

The objects and advantages of the invention are set forth in part herein and in part will be obvious herefrom, or may be learned by practice of the invention, the same being realized and attained by means of instrumentalities and combinations pointed out in the appended claims.

The invention consists in the novel parts, constructions, arrangements, combinations and improvements herein shown and described.

SUMMARY OF THE INVENTION

Figure 1:
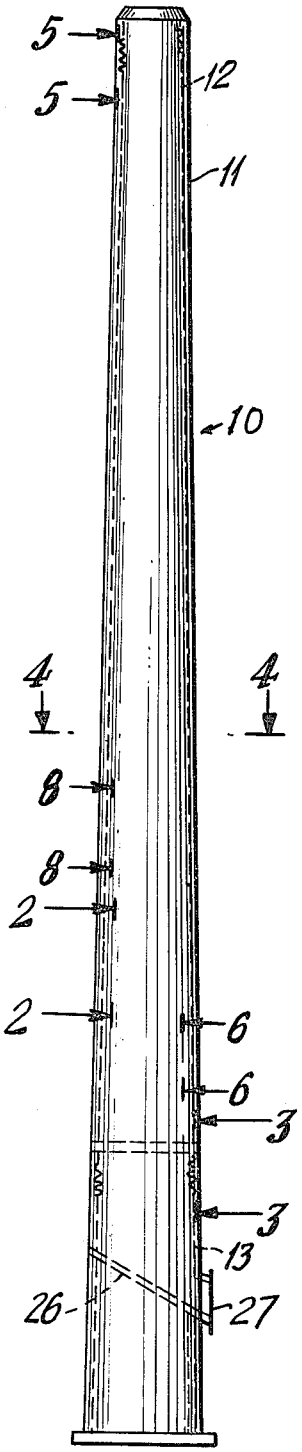
FIG. 1 is a front elevational view of a chimney stack constructed in accordance with the invention.

Briefly described, the present invention is directed to a new and improved design associated with the fabrication and construction of a chimney stack capable of conveying hot gases, generated in conjunction with industrial endeavors, to a height within the atmosphere sufficient to meet current pollution standards, wherein vibratory mechanisms that are capable of being selectively actuated are mounted on the inner core member of said double shell chimney stack so as to provide a means for removing as well as preventing the build up of particulate material on the inner surface of said inner core without requiring the shutting down of said chimney stack. Additionally, there is also incorporated in the overall design of said chimney stack means as part of the inner core of said chimney stack for maintaining the flue gas temperature above the acid dewpoint temperature of the various acid vapors contained in said flue gases passing through said stack as well as additionally incorporating in the overall design of said chimney stack means for creating a pressure differential between the air space existing between the inner core member of said chimney stack and the outer structural column member of said chimney stack and the center passageway of the chimney stack, both of said means reducing to a minimum maintenance requirements associated with said chimney stack as well as extending its operating life.

As herein preferably embodied, the chimney stack comprises an inner core member that is thermally insulated and comprises two (2) separate and distinct structural components which are flexibly joined at a point near the base of said chimney stack as well as an upright outer structural column member capable of providing structural support for said inner core member, said inner core member and said outer structural member being designed such that there exists throughout the major portion of said chimney stack a constant spacing between said members, therebeing selectively positioned on the exterior wall of said inner core member, between said inner core member and said outer structural member, vibrator mechanisms capable of being selectively actuated so as to vibrate said inner core member when desired. In this manner, the double shell chimney stack is in effect self-cleaning without requiring the shutting down of the stack to achieve same since by mechanically vibrating the inner core member of said double shell chimney stack during its normal operation, particulate matter is prevented from building up on said inner surface of said inner core member as well as being dislodged from the inner surface of said inner core member, said dislodged material being either allowed to fail to the bottom of said chimney stack whereupon it is removed in a manner well-known in the prior art or said particulate matter passes out of the top of the chimney stack with the rising gases passing through said chimney stack.

In further keeping with the invention there is additionally provided within said overall design, and in accordance with the invention, as part of the design of said inner core member of said double shell chimney stack a waffle type design thereof wherein a sealed liquified system is provided. By so doing a heated liquid passes through said waffle design of said inner core member of said double shell chimney stack so as to transfer thermal energy to said gases passing through said stack, said thermal energy transferred to said gases being of a sufficient quantity so as to maintain the flue gas temperature at a level above the acid dewpoint temperature of the various acid vapors contained in said flue gases passing through said stack thus preventing condensation of said acid vapors upon the interior of said chimney stack and thereby reducing corrosive structural deterioration of said chimney stack.

Additionally, and keeping with the invention, there is created by mechanical means in the air space between the outer structural column member of said chimney stack and the inner core member of said chimney stack, and the center passageway of said chimney stack a pressure level greater than the pressure level within said center passageway of said chimney stack thereby confining within the center passageway of said chimney stack the gaseous medium being conveyed by said chimney stack without affording an opportunity to the corrosive vapors being conveyed therein by said chimney stack to the upper atmosphere to come into contact with the structural components of said chimney stack.

In further keeping with the invention, there additionally exists a bellows-type expansion seal between the structural components of the inner core member so as to provide a sealed environment capable of conducting gases through said inner core member without the loss of same. Additionally, the baffle structures positioned within the spacing between said inner core member and said upright outer structural column member strengthens the structural integrity of said inner core member as well as providing a means for dampening any excessive vibration generated within said inner core member.

It will be understood that the foregoing general description and the following detailed description as well are exemplary and explanatory of the invention, but are not restrictive thereof.

The accompanying drawings referred to herein and constituting a part hereof, are illustrative of the invention but not restrictive thereof, and, together with the description, serve to explain the principles of the invention.

DESCRIPTION OF A PREFERRED EMBODIMENT

Referring now more particularly to the embodiment of the above invention illustrated in the accompanying drawings, there is illustrated in FIG. 1 a chimney stack fabricated and constructed in accordance with the instant invention and indicated generally by reference numeral 10.

In accordance with the invention, chimney stack 10 comprises an upright outer structural column member 11 constructed of any well-known structural material commonly used in the prior art, be it steel, brick, or otherwise, the purpose of said upright outer structural column member 11 being that of providing a structural housing wherein an inner core member is positioned and given structural support.

In conjunction with the instant invention, said inner core member comprises two (2) separate and distinct components, to wit: an upper inner core member 12 and a lower inner core member 13.

Figure 3:
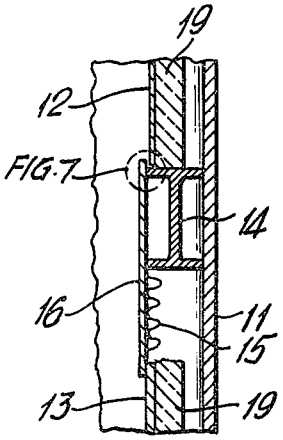
FIG. 3 is an enlarged partial vertical sectional view of the chimney stack illustrated in FIG. 1 and taken along lines 3—3, illustrating the point where the lower structural component of the inner core member meets the upper component of the inner core member.

As illustrated in FIG. 3 of the drawings, upper inner core member 12 rests upon "I" beam 14 which is structurally affixed to upright structural column member 11. Although there is illustrated an "I" beam as the means for providing said structural support to upper inner core member 12, it is within the scope of this invention to utilize in place of "I" beam 14, any other means of support known within the prior art. As illustrated in FIG. 3, "I" beam 14 circumvents the entire inner perimeter of upright outer structural column member 11 thereby providing a continuous structural support platform upon which upper inner core member 12 rests. As depicted in FIG. 3 of the drawings, lower inner core member 13 is positioned beneath "I" beam 14 and has affixed between its upper surface and the lower portion of "I" beam 14 a flexible, accordian-like seal 15 which permits vertical as well as horizontal movement of both lower inner core member 13 as well as upper inner core member 12 independent of each other and without transferring structural stress or vibrations from one member to the other. Additionally, an air-tight seal at said location is achieved, so as to prevent the escape of gases from within said inner core member as a result of the above design and same represents a structural interrelationship that occurs throughout the interior circumference of chimney stack 10 at said location. In keeping with the invention, accordian-like seal 15 can be fabricated from a variety of materials as long as said material is capable of withstanding the thermal as well as the structural criteria inherent in said use, stainless steel being herein preferably embodied.

Figure 7:
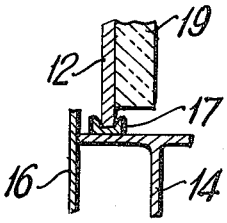
FIG. 7 is an enlarged partial vertical sectional view of a portion of the chimney stack illustrated in FIG. 3.

In accordance with the invention and as illustrated in FIG. 3, plate member 16 is structurally affixed to "I" beam 14 throughout the interior circumference of said stack, and overlaps below "I" beam 14 so as to provide a protective structural covering for seal 15. As a result of the above structural arrangement, upper inner core member 12 is structurally supported within stack 10 by "I" beam 14. Additionally, lower inner core member 13, which initially is exposed to the influx of hot gases that are to be channelled upward within chimney stack 10, is capable of expansion due to increases in its temperature, said expansion to be either of a vertical nature or of a horizontal nature, or any combination thereof, flexible seal 15 being of an accordian-like design permitting such expansion without loss from said inner member of any gases being conducted through chimney stack 10 while avoiding the placement of stress upon upper inner core member 12 due to the said thermal expansion of lower inner core member 13. Additionally there is avoided, due to this design, the placement of stress upon lower inner core member 13 due either to the weight of upper inner core member 12 or its expansion due to its own thermal expansion thus freeing upper inner core member 12 to respond to its own thermal loading without being restrained by lower inner core member 13. Furthermore, in accordance with this invention, upper inner core member 12, due to the present design, does not transmit to lower inner core member 12, any structural stress due to the intentionally created vibrations within said upper inner core member 12. To assist in dampening the transmittal of any form of stress imposed upon or within upper inner core member 12 to any other portion of chimney stack 10, channel member 17 is affixed to "I" beam 14 as illustrated in FIG. 7 around the entire perimeter of the chimney stack, thus providing a structural trough into which upper inner core member 12 rests without restraint so as to be able to expand, contract or vibrate as well as rotate in response to thermal as well as mechanical stresses or other loading criteria.

In keeping with the invention and as set forth in FIG. 1, opening 27 provides the conduit through which gases can pass into chimney stack 10, said chimney stack being built to any desired height sufficient to meet appropriate design criteria based upon a particular purpose or use.

As illustrated in FIG. 1, blanking plate 26 is illustrated showing that at opening 27 of chimney stack 10, said stack has its lower end sealed off by blanking plate 26 which is angularly positioned at said location. By so utilizing blanking plate 26, heat loss through the lower portion of said stack is reduced to a minimum as well as having provided a means for deflecting upward hot gases introduced into stack 10 whereby the thermal stresses associated with the introduction of said hot gases is distributed over a greater area than merely the interior portion of said stack appearing opposite to opening 27.

Figure 4:
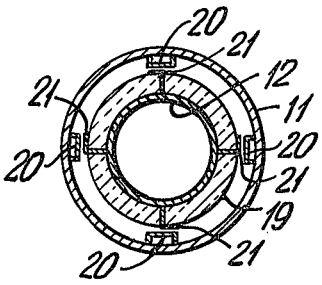
FIG. 4 is a cross-sectional view of the chimney stack illustrated in FIG. 1 and taken along lines 4—4.

As is readily apparent upon viewing FIGS. 1 and 4, upright outer structural column member 11 has a circular cross-section and has concentrically positioned therein inner core members 12 and 13.

In keeping with the invention, a constant spacial distance is maintained between upright outer structural column member 11 and upper and lower inner core members 12 and 13 respectively throughout the entire height of chimney stack 10. By maintaining this consistent and uniform spacial relationship between said structures throughout the length of chimney stack 10, turbulence due to thermal transfer within said spacing is reduced to a minimum.

As illustrated in FIG. 4 and in keeping with the invention, there is depicted a cross-sectional view of chimney stack 10 wherein there is illustrated the positioning of inner core member 12 concentrically positioned within upright outer structural member 11. Additionally illustrated therein is thermal insulative material 19 which can be any heretofore known thermal insulative material currently available on the market, a preferred material being known in the prior art is fiberglass insulation.

As illustrated in FIG. 4, there are periodically positioned along the height of chimney stack 10 structural members 20 and angle members 21, structural members 20 being equally positioned about the inner circumference above outer structural column member 11 while angle members 21 are affixed to upper inner core member 12 at points coincident with the positioning of structural members 20, said structural members 20 and angle members 21 inter-reacting such that upon having outer structural column member 11 move off of its axis due to wind, contact is made by the appropriate structural members 20 and their corresponding angle members 21 such that the inner core comprising inner core members 12 and 13 provide additional structural stability to said chimney stack, and vice versa, assuming inner core members 12 and 13, due to various stresses imposed thereon, move off of their axes.

Figure 5:
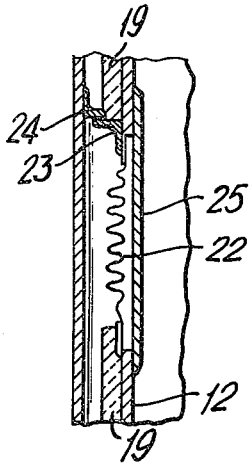
FIG. 5 is an enlarged partial sectional view of the chimney stack illustrated in FIG. 1 and taken along lines 5—5.

As illustrated in FIG. 5, there is depicted the top of upper inner core member 12 wherein an accordian-like seal 22, identical in design and fabrication to accordian-like seal 15 is utilized, upper inner core member 12 being flexibly affixed to upright outer structural column member 11 without providing a fixed restraint upon the movement of upper conical-shaped inner core member 12.

As illustrated in FIG. 5, accordian-like seal 22 is structurally affixed to upper inner core member 12 at one end and at its other end, accordian-like seal 22 is structurally affixed to angle member 23. Angle member 24 is structurally affixed to outer structural column 11 such that angle members 23 and 24 overlap and are structurally affixed to each other at said overlap.

The above relationship of angle members 23 and 24 and the affixing of accordian-like seal 22 to angle member 23 as well as to upper inner core member 12 represents a structural inter-relationship that occurs throughout the interior circumference of chimney stack 10 at the location represented by FIG. 5. As illustrated in FIG. 5, there is provided a means whereby upper inner core member 12 at its upper extremity is permitted to move within said chimney stack in response to thermal as well as mechanical and structural loading without placing structural strain upon outer structural column member 11. Additionally, said arrangement provides an air-tight seal such that the gases conveyed by said inner core members 12 and 13 are not dissipated to the outside atmosphere prior to reaching the top of said chimney stack.

Additionally, in FIG. 5, there is illustrated a cover plate 25 that prevents the accumulation of soot and other debris within the spacing provided by accordian-like seal 22, thus avoiding the buildup of material that, upon reaction to moisture, would cause corrosive deterioration of accordian-like seal 22.

Figure 6:
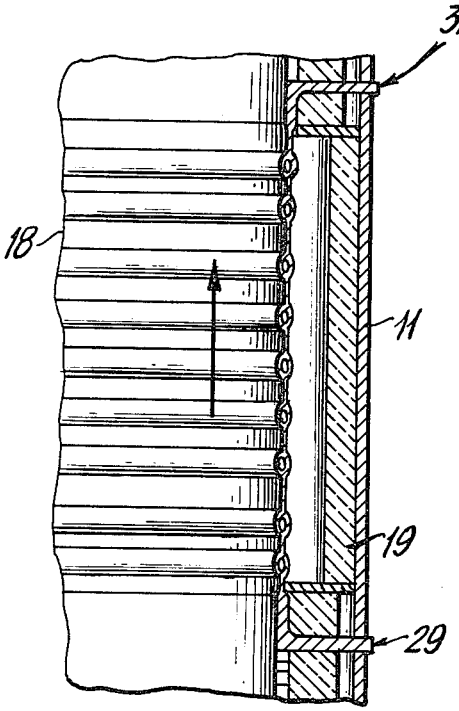
FIG. 6 is an enlarged partial vertical sectional view of the chimney stack illustrated in FIG. 1 and taken along lines 6—6 illustrating the design of said inner core member of said chimney stack wherein there is provided the means whereby thermal energy is imparted to the flue gases passing through said chimney stack so as to maintain said flue gas temperature above the acid dewpoint temperature of the various acid vapors contained in said flue gases as said flue gases pass through said chimney stack.

As illustrated in FIG. 6, a heat transfer system is depicted within stack 10 which is capable of transferring thermal energy via radiation to the hot gases passing through said stack so as to maintain the flue gas temperature above the acid dewpoint temperature levels of the various acid vapors contained in said flue gases passing through said stack.

More particularly, there is contained a waffle-like structure 18 which comprises that portion of inner core members 12 and/or 13 as design criteria dictates sufficient to transfer that quantity of thermal energy to the gases passing through the center of said chimney stack so as to maintain them above the dewpoints of the various acid vapors contained therein thereby avoiding corrosive damage to the chimney stack. As illustrated in FIG. 6, heat transfer media passes through waffle-like liner 18 within the interior of stack 10, via input conduit opening 32 and passes out of said waffle-like structure 18 via output conduit opening means 29 to a heat exchanger and through a pumping means well known in the prior art, both not shown, and back through said stack to waffle-like structure 18, thus providing a closed system whereby an external source of energy is utilized to maintain the gases passing through said stack above a predetermined temperature level.

Figure 2:
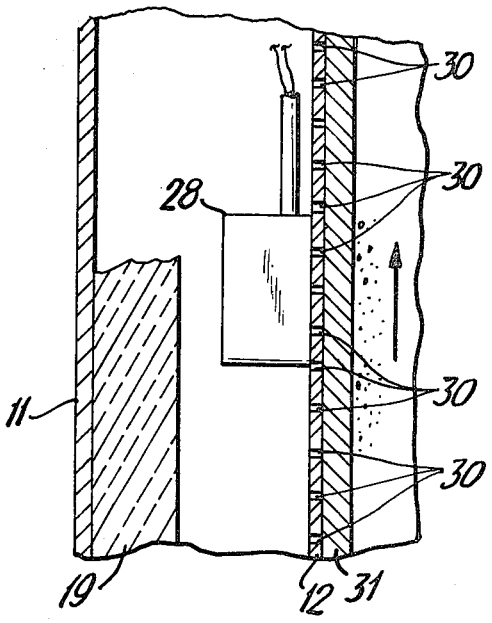
FIG. 2 is an enlarged partial vertical sectional view of the chimney stack illustrated in FIG. 1 and taken along lines 2—2 illustrating the positioning of a vibratory mechanism onto the exterior wall of the inner core member of the chimney stack illustrated in FIG. 1 and positioned between said inner core member and said outer structural member of said stack.

Reference is now herein made to FIG. 2 wherein there is depicted a vibratory mechanism 28 positioned onto the exterior wall of inner core member 12 and thus positioned between said inner core member 12 and said outer structural member 11 of stack 10. In keeping with the invention, vibratory mechanism 28 is structurally affixed to the exterior wall of inner core member 12 in any manner well known in the prior art, be it by welding, mechanical fastening or the like. Additionally, vibratory mechanisms 28 are positioned about and throughout stack 10 as depicted in FIG. 2 in such a fashion and manner as design criteria dictate so as to impart to upper inner core member 12 or lower inner core member 13, as the case may be, the optimum vibratory energy. Although it is within the scope of this invention to utilize any number of vibratory mechanisms 28 within stack 10 as hereinabove described, a preferred embodiment envisions the utilization of three such vibratory mechanisms 28, two associated with upper inner core member 12 and one associated with lower inner core member 13, the two vibratory mechanisms 28 associated with upper inner core member 12 each appearing opposite each other on the exterior wall of inner core member 12, one such vibratory mechanism positioned one-third of the distance down from the top of upper inner core member 12 and the second such vibratory mechanism positioned one-third of the distance up from the bottom of upper inner core member 12 while the third such vibratory mechanism 28 associated with lower inner core member 13 is positioned midway up the length thereof and opposite opening 27.

In accordance with the invention, it is additionally within the scope thereof to design the structural placement of vibratory mechanisms 28 such that their position within stack 10 can be selectively moved about the exterior wall of upper inner core member 12 or lower inner core member 13, as the case may be, same to be achieved by any mechanical means well known in the prior art, be it by having said vibratory mechanisms 28 being selectively self-propelled along an array of train-like rails, or otherwise, there being achieved by such a feature the ability to selectively position adjacent any buildup of deposits within stack 10 said vibratory mechanisms 28.

Additionally illustrated in FIG. 2 are openings 30 appearing through upper inner core member 12 adjacent insulative lining 31, both of which will be explained in detail hereinafter.

In keeping with the invention, vibratory mechanism 28 can be any one of a number of devices well known in the prior art, be it operated on electrical, pneumatic, hydraulic or the like principles, the only overall criteria required thereof being that said mechanism is capable of being selectively actuated and that it is capable of imparting to either upper inner core member 12 or lower inner core member 13 sufficient mechanical vibration so as to remove any particulate material that would adhere to the inner surfaces of upper inner core member 12 or lower inner core member 13, as the case may be, as well as to avoid the build up thereof.

Figure 8:
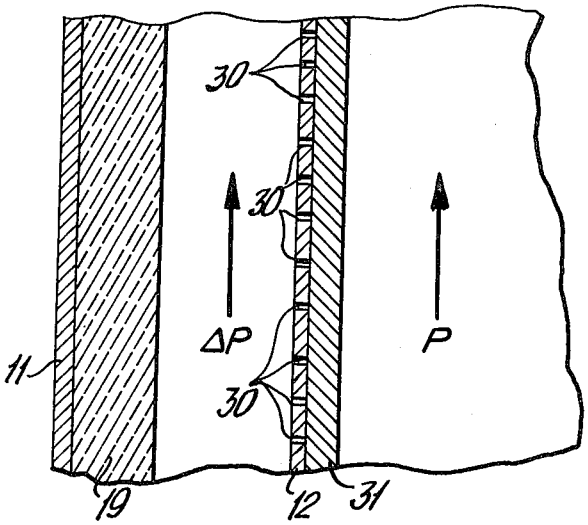
FIG. 8 is an enlarged partial vertical sectional view of the chimney stack illustrated in FIG. 1 and taken along lines 8—8 illustrating the design of said inner core member of said chimney stack wherein there is illustrated the implementation of that feature of the present invention wherein there is created an increase in pressure level in the air space between the outer structural column member of said chimney stack and its inner core member as compared to the pressure level within the center passageway of said chimney stack.

Reference is now made to FIG. 8 where there is depicted an enlarged partial vertical sectional view of chimney stack 10 illustrating the implementation of that feature of the present invention wherein an increase in pressure level is generated in the air space between outer structural column member 11 and upper inner core member 12 as compared to the pressure level within the center passageway of chimney stack 10 same being generated by means well known in the prior art so as to prevent and/or otherwise minimize the contact between the gaseous vapors being conveyed through the center passageway of chimney stack 10 and its structural components. As illustrated in FIG. 8, and in keeping with this aspect of the invention, upper inner core member 12 as well as lower inner core member 13 have formed throughout their structure in accordance with design criteria openings 30, same permitting the passage therethrough of a gaseous media. By separate means, well known in the prior art, there is pumped into the air space existing between upright structural column member 11 and either upper inner core member 12 or lower inner core member 13 as the case may be, by the utilization of external air pumps, air, or any other gaseous media, whose air pressure is at a level greater than the air pressure of the gaseous flow coming through the center passageway of chimney stack 10. As illustrated in FIG. 8, P indicates the air pressure of the gaseous flow passing through the center passageway of chimney stack 10 whereas $\Delta P$ represents a pressure level within the air space existing between outer structural column member 11 and upper inner core member 12, $\Delta P$ being at a predetermined pressure level greater than P, it being within the scope of this invention to provide monitoring means within chimney stack 10 so as to achieve a constant difference in pressure level between $\Delta P$ and P during all conditions of operation of said chimney stack, said monitoring means being regulative of the exterior air pumps that create the increased pressure level represented by $\Delta P$. Although mention is herein made of the utilization of exterior air pumps to achieve the $\Delta P$ condition referred to above, it is within the scope of this invention to use any known means to create said $\Delta P$ condition, be it by mechanical, electrical, or other means well known in the prior art.

In accordance with the above, by having a greater pressure level exist within the air space occurring between outer structural column member 11 and upper exterior wall member 12 as compared to the center passageway of chimney stack 10, there is created a means whereby the gaseous media in the center passageway of chimney stack 10 is inhibited from coming into contact with and otherwise seeping through insulative lining 31 and upper structural column member 12 or lower column member 13 as the case may be thereby avoiding same incurring corrosive damage due to the various vapors, acid or otherwise that are being carried through chimney stack 10.

As a result of the above, there is herein achieved an overall structural design for a chimney stack which provides a self-cleaning capability for same as well as achieves built in preventive measures to avoid corrosive damage to said chimney structure by having in one instance the acid vapors passing through said chimney stack maintained at a temperature level above their respective acid dewpoints and in the other instance provides a pressure differential within said chimney stack structure that seeks to confine the gaseous media passing through said chimney stack to within the center passageway thereof and out of contact with the structural components thereof.

The proceeding description and accompanying drawings relate primarily to a specific embodiment of the invention, and the invention in its broader aspects should not be so limited to one specific embodiment as herein shown and described, but departures may be made therefrom within the scope of the accompanying claims without departing from the principles of the invention and without sacrificing its chief advantages.

I claim:

1. A double shell chimney stack capable of conveying hot gases that is self-cleaning by design comprising the following:

(a) an outer hollow structural column member;

(b) a hollow inner core member contained within said outer hollow structural column member, said hollow inner core member consisting of an upper inner core member and a lower inner core member, said upper inner core member and said lower inner core member being separate and distinct independent structures with said upper inner core member receiving structural support from said outer hollow structural column member;

(c) a flexible seal joining said upper and lower portions of said hollow inner core member so as to permit the movement of said upper inner core member and said lower inner core member independent of each other while providing an air-tight seal between said upper inner core member and said lower inner core member so as to prevent the escape of hot gases being conveyed by said double chimney stack prior to said gases exiting at the top of said double shell chimney stack;

(d) means incorporated within the design of said hollow inner core member for selectively maintaining the temperature level of the hot gases being conveyed by said double shell chimney stack at a predetermined point above the dew point of the acid vapors contained within said hot gases being conveyed so as to avoid the condensation upon the internal structure of said double shell chimney stack of said acid vapor contained within said hot gases;

(e) vibratory means affixed to the exterior surface of said hollow inner core member capable of selectively vibrating said hollow inner core member so as to dislodge therefrom as well as preventing the adhering thereto of particulate material; and (f) means for generating between the air space defined between said hollow inner core member and said outer hollow structural member a selective pressure level that is greater than the pressure level within the center passageway of said double shell chimney stack so as to inhibit said hot gases being conveyed by said double shell chimney stack from coming into contact with any physical portion of said double shell chimney stack.

2. A double shell chimney stack as described in claim 1 wherein said vibratory means is electrically operated.

3. A double shell chimney stack as described in claim 1 wherein said vibratory means is hydraulically operated.

4. A double shell chimney stack as described in claim 1 wherein said vibratory means is pneumatically operated.

5. A double shell chimney stack as described in claim 1 wherein openings are formed through said hollow inner core member so as to facilitate the affect of said pressure level differential created between said air space defined between said hollow inner core member and said hollow structural member, and the center passageway of said double shell chimney stack.

* * * * *